US006711376B2

(12) United States Patent
Suzuki et al.

(10) Patent No.: US 6,711,376 B2
(45) Date of Patent: Mar. 23, 2004

(54) MANUAL FEED APPARATUS

(75) Inventors: Tomoo Suzuki, Hachioji (JP); Kazuyoshi Kimura, Hachioji (JP); Susumu Okui, Hachioji (JP); Hideo Isohara, Hachioji (JP)

(73) Assignee: Konica Corporation (JP)

( * ) Notice: Subject to any disclaimer, the term of this patent is extended or adjusted under 35 U.S.C. 154(b) by 17 days.

(21) Appl. No.: 10/244,851

(22) Filed: Sep. 16, 2002

(65) Prior Publication Data

US 2003/0053834 A1 Mar. 20, 2003

(30) Foreign Application Priority Data

Sep. 18, 2001 (JP) ..... 2001-283073

(51) Int. Cl.[7] ..... G03G 15/00
(52) U.S. Cl. ..... 399/392
(58) Field of Search ..... 399/361, 381, 399/388, 391, 392, 393; 271/145, 162, 163, 164

(56) References Cited

U.S. PATENT DOCUMENTS 6,215,970 B1 * 4/2001 Yoshikawa et al. ..... 399/124
6,330,423 B1 * 12/2001 Kitazawa ..... 399/392

* cited by examiner

*Primary Examiner*—Hoan Tran
(74) *Attorney, Agent, or Firm*—Muserlian, Lucas and Mercanti

(57) ABSTRACT

According to this invention, in a manual feed apparatus having an opening/closing tray which can be stored in an image forming apparatus main body by swing operation, and a feedout member which feeds a sheet stacked on the opening/closing tray, the opening/closing tray is swingably connected to a vertically movable support member which is restricted to be movable in a vertical direction, and the apparatus includes a vertically movable unit which moves the vertically movable support member in the vertical direction.

5 Claims, 6 Drawing Sheets

MANUAL FEED APPARATUS

BACKGROUND OF THE INVENTION

1. Field of the Invention

This invention relates to a manual feed apparatus to be mounted on an image printing apparatus such as a copying machine, a laser beam printer, a facsimile apparatus, and the like, and particularly to a manual feed apparatus that maintains stable feed performance even when a large amount of sheets are stacked on it.

2. Description of the Prior Art

As a manual feed apparatus employed as one sheet feed apparatus in an image printing apparatus such as a copying machine, a laser beam printer, and the like, one is conventionally known in which a plurality of sheets mainly comprised of print sheets are stacked on a sheet feed table and are sequentially fed starting from the uppermost sheet. In Japanese Unexamined Patent Publication No. 2001-146343, the inventors of the present applicant disclose an example of a method with which a manual sheet feed table serving as a print sheet stacking member in a manual feed apparatus can be opened/closed with respect to an image printing apparatus such as a laser beam printer by pivot operation, so the manual sheet feed table can be used as a feed apparatus.

The manual feed apparatus disclosed in the above Japanese Unexamined Patent Publication No. 2001-146343 and the like is comprised of a push-up plate for urging a sheet against a feedout roller when the print sheet is fed from the manual feed apparatus, and a manual sheet feed table (opening/closing tray) which is opened/closed and stored. One end of the opening/closing tray is fixed to the image forming apparatus main body. Hence, when the opening/closing tray is in use (in feeding operation), it cannot be vertically moved in an open state. When the manual sheet feed table is to be stored, it is stored after its print sheet stacking surface is closed. When the manual sheet feed table is to perform feed operation, its print sheet stacking surface is opened. At the same time, the push-up plate located in front of (downstream of) the opening/closing tray in the feed direction is pivotally driven and inclined, so it is vertically moved. Thus, the sheet is urged against the feedout roller. With this arrangement, when a large amount of print sheets are stacked, the amount of displacement of the push-up plate which is displaced by pivotal driving increases. Then, the angle at which the sheet abuts against the feedout roller changes largely in accordance with the remaining stacked amount of the sheets. As the angle of inclination becomes large, the inclination of the print sheet in the vicinity of the feedout roller increases to adversely affect the feed performance. In this manner, in the feed apparatus in which feeding conditions change continuously largely, it is very difficult to maintain high feed performance. To decrease the amount of displacement of the push-up plate in the vertical direction and to reduce the angle of inclination, the push-up plate may be formed large, and its pivotal fulcrum may be set far from the feedout roller. Then, however, the feedout roller is positioned deep inside the main body. Consequently, when jamming occurs, it is difficult to recover. Also, the size of the image forming apparatus becomes large.

SUMMARY OF THE INVENTION

The present invention has been made in order to solve the above drawbacks of the prior art, and has as its object to provide a manual feed apparatus with which even when the number of sheets that can be stacked on the manual feed apparatus is increased, stable sheet feed performance can be maintained without increasing the size of the image forming apparatus or without degrading the recovery properties against jamming.

In order to achieve the above object, according to the main aspect of the present invention, there is provided a manual feed apparatus having an opening/closing tray which can be stored in an image forming apparatus main body by swing operation, and a feedout member which feeds a sheet stacked on the opening/closing tray, wherein the opening/closing tray is swingably connected to a vertically movable support member which is restricted to be movable in a vertical direction, and the apparatus comprises a vertically movable unit for moving the vertically movable support member in the vertical direction.

According to the second aspect of the present invention, there is provided a manual feed apparatus wherein the sheet is abutted against the feedout member by vertical movement of the vertically movable unit according to the main aspect According to the third aspect of the present invention, there is provided a manual feed apparatus wherein the vertically movable unit according to the second aspect comprises a rack gear provided to the opening/closing tray or the vertically movable support member, and a pinion gear engageable with the rack gear.

According to the fourth aspect of the present invention, there is provided a manual feed apparatus wherein both the rack gear and the pinion gear according to the third aspect form helical gears, the apparatus has a reference surface on a stationary portion which is not moved by the vertical movement, and an abutting portion on the vertically movable support member, and the abutting portion is abutted against the reference surface by a force in a thrust direction which is generated by driving operation of the pinion gear, thereby positioning the opening/closing tray in a direction perpendicular to a feed direction.

According to the fifth aspect of the present invention, there is provided a manual feed apparatus wherein the vertically movable unit according to the main aspect comprises a string material attached to the vertically movable support member, and a take-up member, attached to a stationary portion which is not moved by the vertical movement, to take up the string member.

As is apparent from the aspects described above, according to the present invention, the manual feed table which is opened/closed and stored is vertically moved in the vertical direction, thereby always setting constant the angle of the sheet with respect to the feedout roller. Therefore, a manual feed apparatus can be provided with which no matter how the number of sheets that can be stacked is increased, stable sheet feed performance can be maintained without increasing the size of the image forming apparatus or without degrading the processing performance against jamming.

In particular, according to the fourth aspect, the abutting member is provided to be fixed to the apparatus main body. Part of the vertical driving force is converted into the thrust direction by using a rack-and-gear mechanism having helical gears, so the vertically movable support member is abutted against the reference surface of the abutting surface. Therefore, in vertical movement, variations in sheet position in the direction perpendicular to the sheet feed direction, which is caused by the backlash of the vertically movable mechanism portion such as the vertically movable support members, guide rails, and the like, can be prevented.

The above and many other objects, features and advantages of the present invention will become manifest to those skilled in the art upon making reference to the following detailed description and accompanying drawings in which preferred embodiments incorporating the principle of the present invention are shown by way of illustrative examples.

DETAILED DESCRIPTION OF THE PREFERRED EMBODIMENTS

Figure 1:
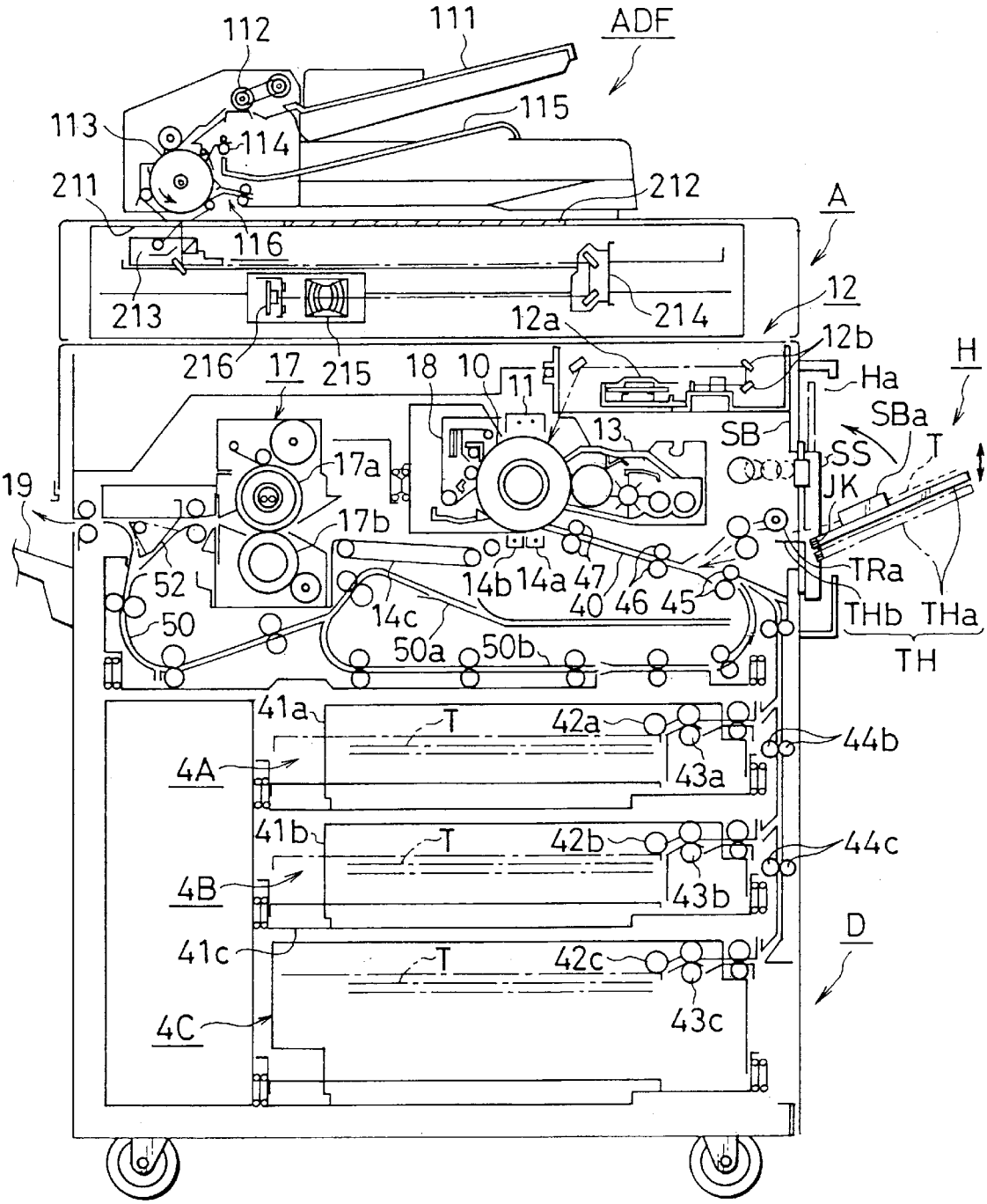
FIG. 1 is a sectional view showing the schematic overall arrangement of a digital composite machine using an electrophotographic system as an embodiment of an image printing apparatus that has a manual feed apparatus according to the present invention.

Several preferred embodiments of the present invention will be described with reference to the accompanying drawings.

The following detailed description does not limit the technical scope of the claims or the meanings of the terms. The following decisive description on the embodiments of the present invention merely shows the best mode and does not limit the meanings of the terms or the technical scope of the present invention. As the sheets, print sheets, OHTs (OverHead Transparencies), labels, and the like are used, and the following description of the embodiments will be made by way of print sheets which are used mainly. In the following description, each roller for conveying the print sheet as the sheet is formed of a pair of driving and driven rollers, and is driven (rotated) by a driving mechanism (not shown) which is driven by a drive signal sent from a controller (not shown). The manual feed apparatus or vertically movable mechanism to be described hereinafter is generally formed by using a pair of symmetrical members. Accordingly, a description will be made on only one of the symmetrical members. Note that the description applies to both of the pair of symmetrical members which are denoted by the same reference numerals. Furthermore, while the image printing apparatus of this embodiment enables image printing on the two surfaces of a sheet, the present invention is not limited to this arrangement.

The image printing apparatus shown in FIG. 1 is an image printing apparatus having digital composite functions. The image printing apparatus has an automatic document feeder ADF on the upper portion of its apparatus main body, and is comprised of an image reading section A, image processing section B (not shown), image forming section C, and sheet feed section D.

The automatic document feeder ADF is formed on the upper portion of the apparatus main body, and feeds out documents one by one and delivers a document from which an image has been read. A plurality of documents set on a document table 111 are separated by a document separation roller 112, and are conveyed one by one. The document separated and conveyed by the document separation roller 112 is conveyed by a document convey roller 113, and its image is read by the lower image reading section A through a slit 211. The document from which the image has been read is delivered by a document delivery roller 114 onto a document delivery table 115. When reading images on the two surfaces of a document, the document from which the image on the upper surface has been read is turned over by a document inverting section 116, and is conveyed by the document convey roller 113 again. The image on the lower surface of the document is then read by the image reading section A through the slit 211. The document from which the image on the lower surface has been read is delivered by the document delivery roller 114 onto the document delivery table 115. This process is repeated a number of times corresponding to the number of document pages placed on the document table 111, to read images of the document pages.

The automatic document feeder ADF can be fallen down entirely. When the automatic document feeder ADF is raised to open a portion above a platen glass plate 212, a document can be placed on the platen glass plate 212 directly. In this embodiment, the image of the document is read while the document is being conveyed by the document convey roller 113. Alternatively, the image can be read after the document conveyed by the document convey roller 113 is set still on the platen glass plate 212.

The image reading section A reads the image of the document to obtain image data, and is formed on the upper portion in the apparatus main body. The image reading section A is formed of the slit 211 as a slit-like opening serving for reading the image of a document being conveyed by the document convey roller 113 of the automatic document feeder ADF, the platen glass plate 212 serving as a document table on which the document is to be placed (set still) directly, a first mirror unit 213 integrally having a lamp as a light source for irradiating the document with light and a first mirror for reflecting light reflected by the document, a V-mirror unit 214 formed by integrating the second and third mirrors that reflect light from the first mirror, an image forming lens 215 for causing the light from the slit 211 or the light reflected by the document on the platen glass plate 212 to form an image on a CCD image sensor 216, and the linear CCD image sensor 216 serving as an image reading unit that can obtain image information by photoelectrically converting the light image formed by the image forming lens 215.

When the image reading section A reads the document while the document is being fed by the automatic document feeder ADF, the first mirror unit 213 and V-mirror unit 214 move to the left in FIG. 1, so the first mirror unit 213 is located below the slit 211. The document being conveyed above the slit 211 by the document convey roller 113 is irradiated with the lamp. Light reflected by the document becomes incident on the CCD image sensor 216 through the first mirror unit 213, V-mirror unit 214, and image forming lens 215. The CCD image sensor 216 photoelectrically converts the incident light to read the image of the document in the main scanning direction (direction perpendicular to the surface of the sheet of drawing of FIG. 1). Since the document is being moved in the sub-scanning direction by the document convey roller 113, the image of the entire surface of the document can be read. Image information read by the CCD image sensor 216 are sequentially photoelectrically converted into electrical signals (brightness signals) and A/D-converted. The obtained digital signals are then subjected to processes such as density conversion and filtration by the image processing section B. The obtained image data is temporarily stored in the memory and is sent to an exposure optical system 12 serving as an image write unit using a laser write system.

When a document is placed on the platen glass plate 212 directly, its image can be read while moving the first mirror unit 213 and V-mirror unit 214 to the right in FIG. 1 along the platen glass plate 212.

The image forming section C forms an image on the sheet, which is being conveyed at a predetermined process speed, on the basis of the image data obtained by the image reading section A. The image forming section C of this embodiment forms an image in accordance with an electrophotographic process.

In the image forming section C, a charging unit 11 for achieving a charging function, a developing unit 13 for achieving a developing function, a transfer unit 14*a* for achieving a transfer function, a separation unit 14*b* for achieving a separating function, and a cleaning unit 18 for achieving a cleaning function are arranged around a photosensitive drum 10, serving as an image carrier, in the order of operations to form an image forming unit. The photosensitive drum 10 is formed by applying a photoconductive chemical compound on the drum base. For example, an organic photosensitive body (OPC) is used as the photoconductive chemical compound. The photosensitive drum 10 is rotated clockwise in FIG. 1.

The rotating photosensitive drum 10 is uniformly charged by the charging unit 11, and image exposure (image write) based on an image signal read from the memory of the image processing section B is performed on it by the exposure optical system 12. The exposure optical system 12 serving as the image write apparatus has a laser diode (not shown) as an emission source. A laser beam is modulated based on the image information. The optical path of the laser beam is bent by a reflection mirror 12*b* through a rotating polygon mirror 12*a*, an f-θ lens (having no reference numeral), and a cylindrical lens (having no reference numeral), to perform main scanning. Image exposure (image write) is performed at a predetermined position on the photosensitive drum 10, and a latent image is formed by rotating (sub-scanning) the photosensitive drum 10. In this embodiment, character portions are exposed, so a reverse latent image is formed.

The reverse latent image on the photosensitive drum 10 is reverse-developed by the developing unit 13, so a visible image formed of a toner image is formed on the photosensitive layer surface of the photosensitive drum 10.

In the sheet feed section D, sheet feed units 4A, 4B, and 4C having sheet feed cassettes 41*a* to 41*c* serving as sheet storing units that store print sheets T as different-size sheets are formed under the image forming unit. The print sheets T are fed out from any one of the sheet feed cassettes 41*a* to 41*c* by feedout rollers 42*a* to 42*c* as the sheet feedout members, and handling rollers 43*a* to 43*c*, and are conveyed to registration rollers 46 at the inlet of the convey section 40 through intermediate convey rollers 44*a* to 44*c* and guide rollers 45.

A manual feed unit H which can be stored in the apparatus main body by swing operation is provided on the side of the image forming section C. A sheet feed tray TH for stacking the print sheets T is formed of an opening/closing tray THa swingably attached to vertically movable support members SS through a fulcrum shaft JK, and a vertically movable non-swing tray THb which is directly attached to the vertically movable support members SS in front of the opening/closing tray THa in the feed direction. When the manual feed unit H is to be used, it is opened about the fulcrum shaft JK as the support shaft, so the opening/closing tray THa is set in the open state indicated by the solid line, and the print sheets T are stacked on it. When the manual feed mode is selected, the print sheets T which are lifted by vertical movement control until they abut against a feedout roller TRa are conveyed to the registration rollers 46 one by one, as will be described later. When the manual feed unit H will not be used, the print sheets T are removed, and the opening/closing tray THa is closed by swinging it about the rotation shaft JK as the fulcrum, so it can be stored in the image forming apparatus main body.

Regarding the print sheets T, after their skew and one-sided shift state are corrected by the registration rollers 46, they are temporarily stopped. After that, the sheets are fed from the registration rollers 46 again in synchronism with the toner image on the photosensitive drum 10, and are conveyed to the transfer region of the transfer unit 14*a* through pre-transfer rollers 47.

In the transfer region, the toner image on the photosensitive drum 10 is transferred onto the print sheet T by the transfer unit 14*a*. The print sheet T on which the toner image is transferred is conveyed to a fixing unit 17 by a convey belt 14*c*.

The fixing unit 17 has a fixing roller 17*a* and press roller 17*b*. When passing the print sheet T between the fixing roller 17*a* and press roller 17*b*, the toner image is fused and fixed to it by heating and pressure.

The transfer residue toner left on the outer surface of the photosensitive drum 10 after transfer is cleaned by the cleaning unit 18.

The print sheet T, on which the toner image has been fixed on one surface, is delivered onto a sheet delivery tray 19 with an image being formed on the other surface as well, that is, with images being formed on the two surfaces, or with an image being formed on one surface, in accordance with mode selection between double-sided image formation and single-sided image formation to be described hereinafter.

When the double-sided image formation mode is selected at the operating portion, the print sheet T, on which the image has been formed on one surface as described above, moves down along an inverting convey path 50 of an ADU mechanism comprised of an inverting convey path 50 having an inverting/switching member 52, a switch-back path 50*a*, and a second inverting convey path 50*b*. The print sheet T is temporarily loaded in the switch-back path 50*a* and then unloaded such that its upper and lower surfaces are inverted. The print sheet T then passes through the second inverting convey path 50*b* and is fed again by the guide rollers 45 (described above) along a convey section 40. The print sheet T is then temporarily stopped by the registration rollers 46 which corrects the skew and one-sided shift state of the sheet, and is fed again. At the transfer region of the transfer unit 14*a*, the toner image as a lower-surface image formed on the photosensitive drum 10 again is transferred to the lower surface of the print sheet T. After that, the print sheet T is separated, conveyed, fixed, and delivered onto the sheet delivery tray 19.

When the single-sided image formation mode is selected at the operating portion, the print sheet T on which the surface image has been fixed is moved straightly to be delivered onto the sheet delivery tray 19, or is turned over by the inverting/switching member 52, and is delivered onto the sheet delivery tray 19.

A manual feed apparatus according to the present invention will be described in detail with reference to FIGS. 2 to 6.

Figure 2:
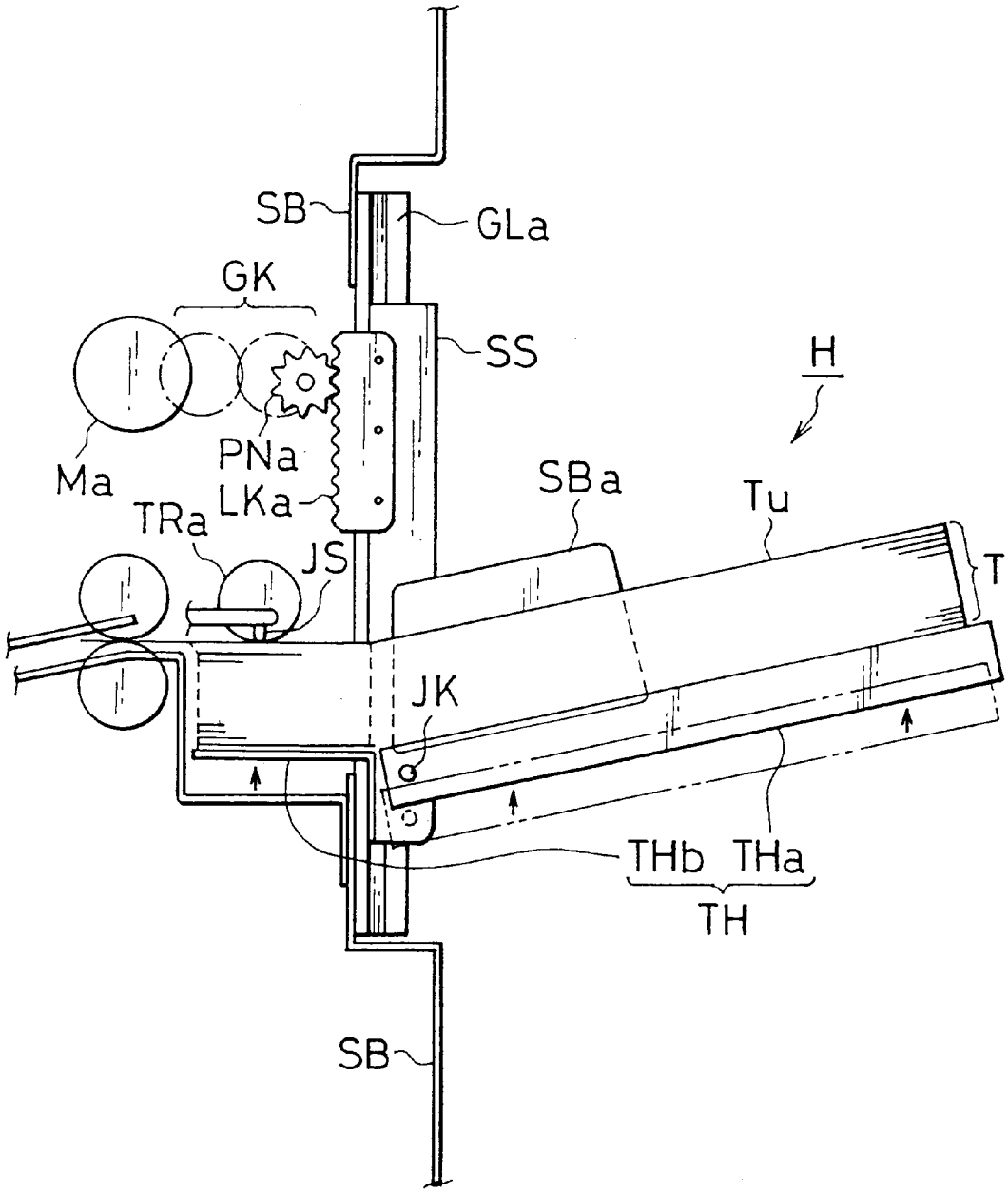
FIG. 2 is a partial enlarged sectional view of the manual feed apparatus of the embodiment shown in FIG. 1, and shows the vertical movement of a sheet feed tray.
Figure 3:
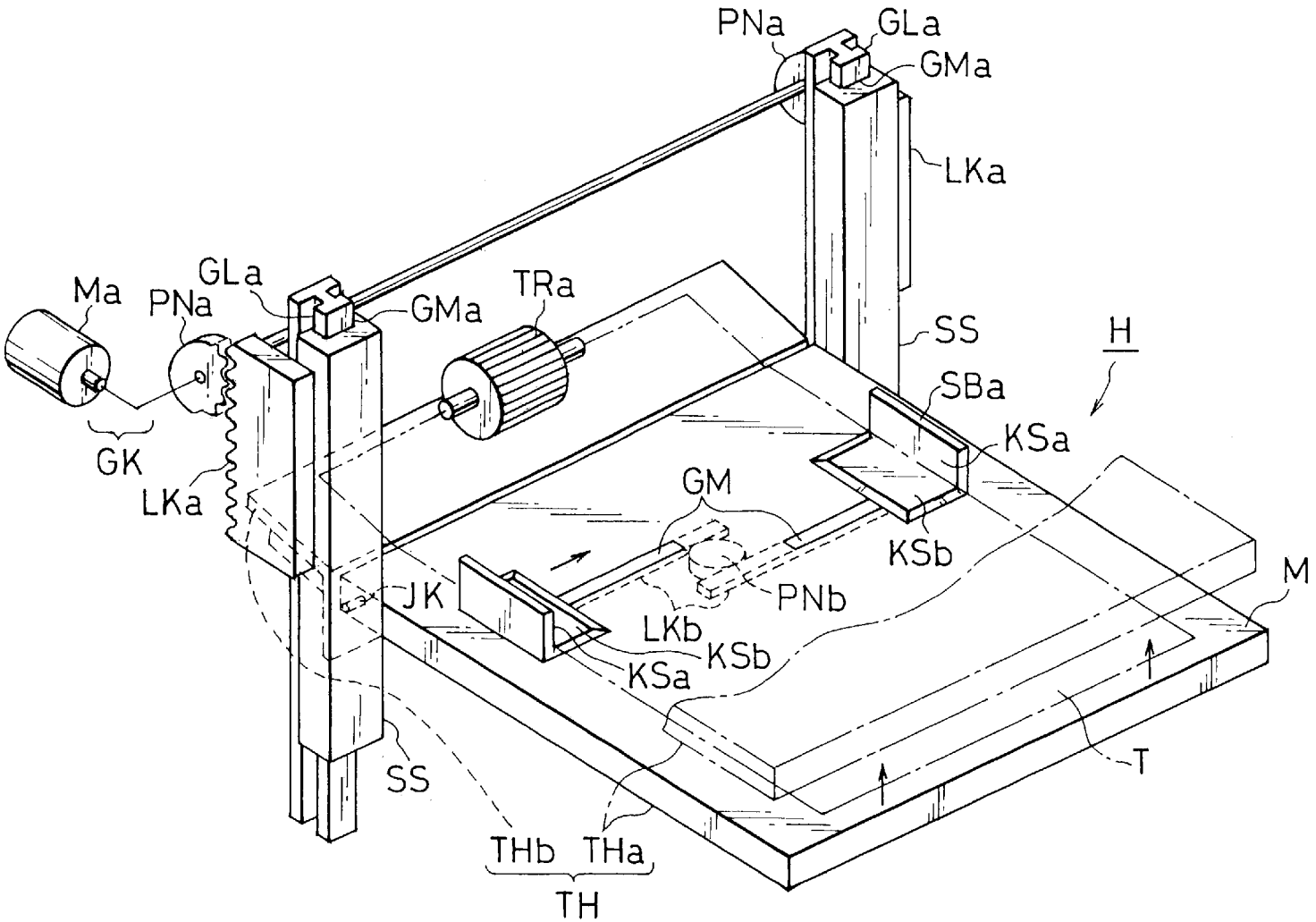
FIG. 3 is an enlarged perspective view showing a practical example of the manual feed apparatus of the present invention.

As shown in FIGS. 2 and 3, the manual feed unit H has the pair of vertically movable support members SS restricted to be movable only in the vertical direction by guide rails GLa, and the sheet feed tray TH with two sides held by the vertically movable support members SS. As described above, the sheet feed tray TH is comprised of the opening/closing tray THa swingably attached to the vertically movable support members SS through the fulcrum shaft JK, and the vertically movable non-swing tray THb which is attached to the vertically movable support members SS on the downstream of the opening/closing tray THa in the feed direction.

Regulating side plates SBa serving as a pair of regulating members for positioning the print sheets T are formed on the two sides of a stacking surface M for the print sheets T of the opening/closing tray THa. Each regulating side plate SBa has a pedestal KSb for stacking the print sheets T, and a side pressure portion KSa for holding the print sheets T stacked on the sheet feed tray TH in a direction perpendicular to the sheet feed direction.

The print sheets T placed on the sheet feed tray TH are guided in the feed direction while they are being regulated by the right and left regulating side plates SBa in the direction perpendicular to the feed direction. The right and left regulating side plates SBa are moved in an interlocked manner with each other by regulating side plate moving rack gears LKb respectively attached to them in the direction perpendicular to the sheet feed direction, and regulating side plate moving pinion gears PNa provided in the sheet feed tray TH, as they are guided by regulating side plate moving guide grooves GM. In other words, the right and left regulating side plates SBa are formed such that they can be moved in the widthwise direction of the sheet and in a direction perpendicular to the sheet feed direction in accordance with the size of the print sheets T, and form guide walls matching the size of the print sheets T.

The rack gears LKa are fixed to the outer surfaces of the pair of right and left vertically movable support members SS, respectively. When a pair of pinion gears PNa engaging with the rack gears LKa are rotated by a driving motor Ma, the vertically movable support members SS and the entire sheet feed tray TH are driven in the vertical direction along the guide rails GLa.

As an example of the vertically movable unit, a pair of right and left rack gears LKa respectively fixed to the pair of vertically movable support members SS, and the pinion gears PNa respectively engageable with the pair of right and left rack gears LKa are used, as shown in FIG. 3. Upon actuation of the driving motor Ma, when the pinion gears PNa are rotated through a driving system GK, the rack gears LKa engaging with them are driven. When the rack gears LKa are driven, the right and left vertically movable support members SS are moved in the vertical direction while they are guided by the T-shaped guide rails GLa fixedly attached to side plates SB (see FIG. 4; not shown in FIG. 3) of the apparatus main body, and T-shaped guide grooves GMa that fit on the guide rails GLa.

An upper limit detection sensor JS for detecting that the stacked print sheets T sufficiently abut against the feedout roller TRa is provided in the vicinity of the feedout roller TRa. At the start of manual sheet feed, the driving motor Ma is driven, so the vertically movable support members SS and the entire sheet feed tray TH are moved upward in the vertical direction through the driving system GK, pinion gears PNa, and rack gears LKa until the upper limit detection sensor JS detects the sheets. During feeding, if the stacked print sheets T are consumed and the height of the uppermost print sheet Tu of the print sheets T becomes low, and the upper limit detection sensor JS no longer detects the print sheets T, the driving motor Ma is immediately driven until the upper limit detection sensor JS detects the print sheets T. Due to this vertical movement control, the uppermost print sheet Tu of the stacked print sheets T can always maintain a constant position with respect to the feedout roller TRa.

When feeding is ended, the driving motor Ma is driven in the reverse direction, so the sheet feed tray TH is moved downward to the lower position.

With the arrangement described above, the entire sheet feed tray TH where the print sheets T are stacked is driven in the vertical direction. Hence, the angle at which the sheet abuts against the feedout roller becomes always constant regardless of the sheet stacking capacity. Therefore, a manual feed apparatus is provided with which no matter how the number of sheets that can be stacked is increased, stable sheet feed performance can be ensured without greatly increasing the size of the image forming apparatus or without degrading the process against jamming.

Figure 4:
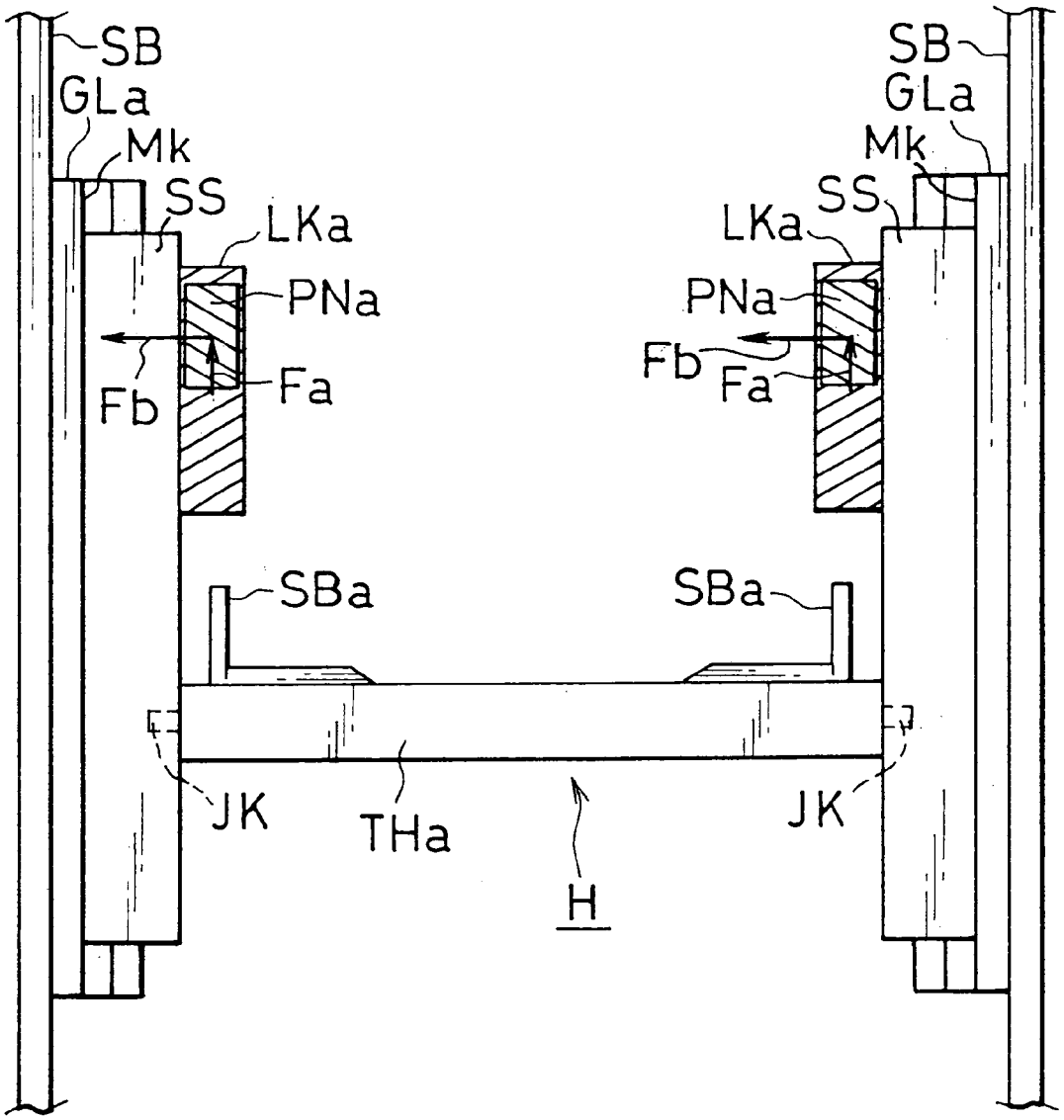
FIG. 4 is a view for explaining a state wherein vertically movable support members are urged against the reference surfaces of abutting plates when a rack-and-pinion mechanism of the manual feed apparatus shown in FIG. 3 uses helical gears.

As shown in FIG. 4, the pinion gears PNa and rack gears LKa form helical gears, and the vertically movable support members SS are abutted against reference surfaces Mk of the guide rails GLa fixed to the side plates SB of the apparatus main body. More specifically, urging forces Fa that urge the gear surfaces (having no reference numerals) of the rack gears LKa by the pinion gears PNa generate force components Fb that urge the vertically movable support members SS with the helical gear surfaces. The force components Fb urge the vertically movable support members SS into tight contact with the reference surfaces Mk. In this manner, part of the vertical driving forces of the rack gears LKa is converted into the thrust direction by using the rack gears LKa and pinion gears PNa that form helical gears, and the vertically movable support members SS integral with the sheet feed tray TH are abutted against the reference surfaces Mk. Therefore, when performing vertical movement, variations in sheet feed position in the direction perpendicular to the sheet feed direction, which is caused by the backlash of the vertically movable mechanism portion such as the vertically movable support members SS, guide rails GLa, and the like, can be prevented.

Figure 5:
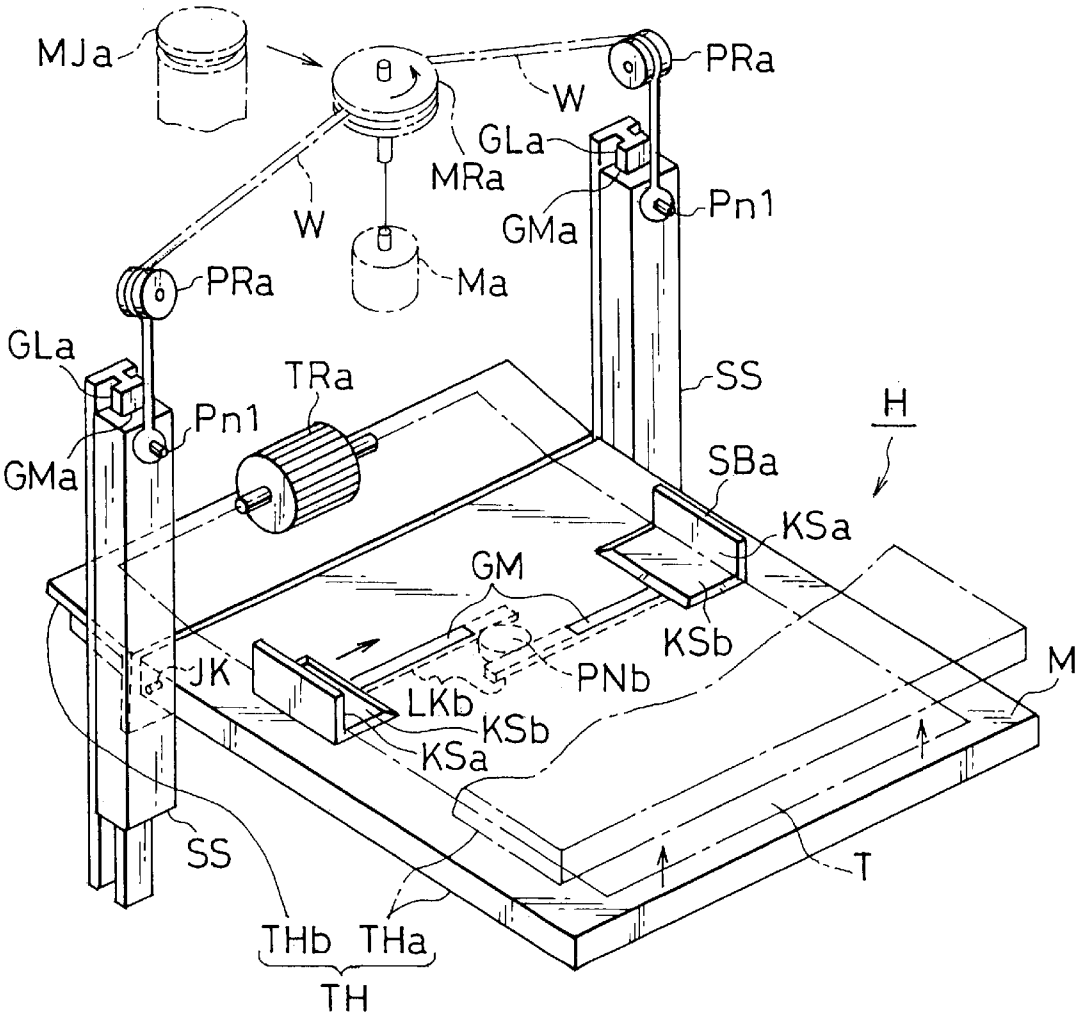
FIG. 5 is an enlarged perspective view showing another example of the vertically movable mechanism of the manual feed apparatus.

According to another example of the vertically movable unit, as shown in FIG. 5, the vertically movable unit may use a string material W attached to pins Pn1 formed at the distal ends of the right and left vertically movable support members SS, and a take-up pulley MRa used as a take-up roller member for taking up the string material W. The pivotal take-up pulley MRa is rotated by the driving motor Ma, so the string material W is taken up by the take-up pulley MRa through pulleys PRa formed on the upper portions of right and left vertically movable support members SS, thereby vertically moving the sheet feed tray TH. Furthermore, a take-up shaft MJa may be used in place of the take-up pulley MRa, and the sheet feed tray TH may be vertically moved by taking up the string material W on the take-up shaft MJa.

With the vertically movable unit having the above arrangement as well, the conventional drawbacks described above are overcome, and the manual feed table which is opened/closed and stored is moved in the vertical direction, thereby always setting constant the angle of the sheet with respect to the feedout roller. Therefore, a manual feed apparatus is provided with which no matter how the number of sheets that can be stacked is increased, stable sheet feed performance can be maintained without increasing the size of the image forming apparatus or without degrading the processing performance against jamming.

In FIG. 3 or 5 described above, the driving motor Ma may be provided separately to vertically move the right and left rack gears LKa or the vertically movable support members SS, or to vertically move the vertically movable support members SS directly. Note that control operation must be performed to maintain the parallel degree of the sheet feed tray TH, that is, to uniformly maintain the heights of the two vertically movable support members SS located at the two ends of the sheet feed tray TH.

Figure 6:
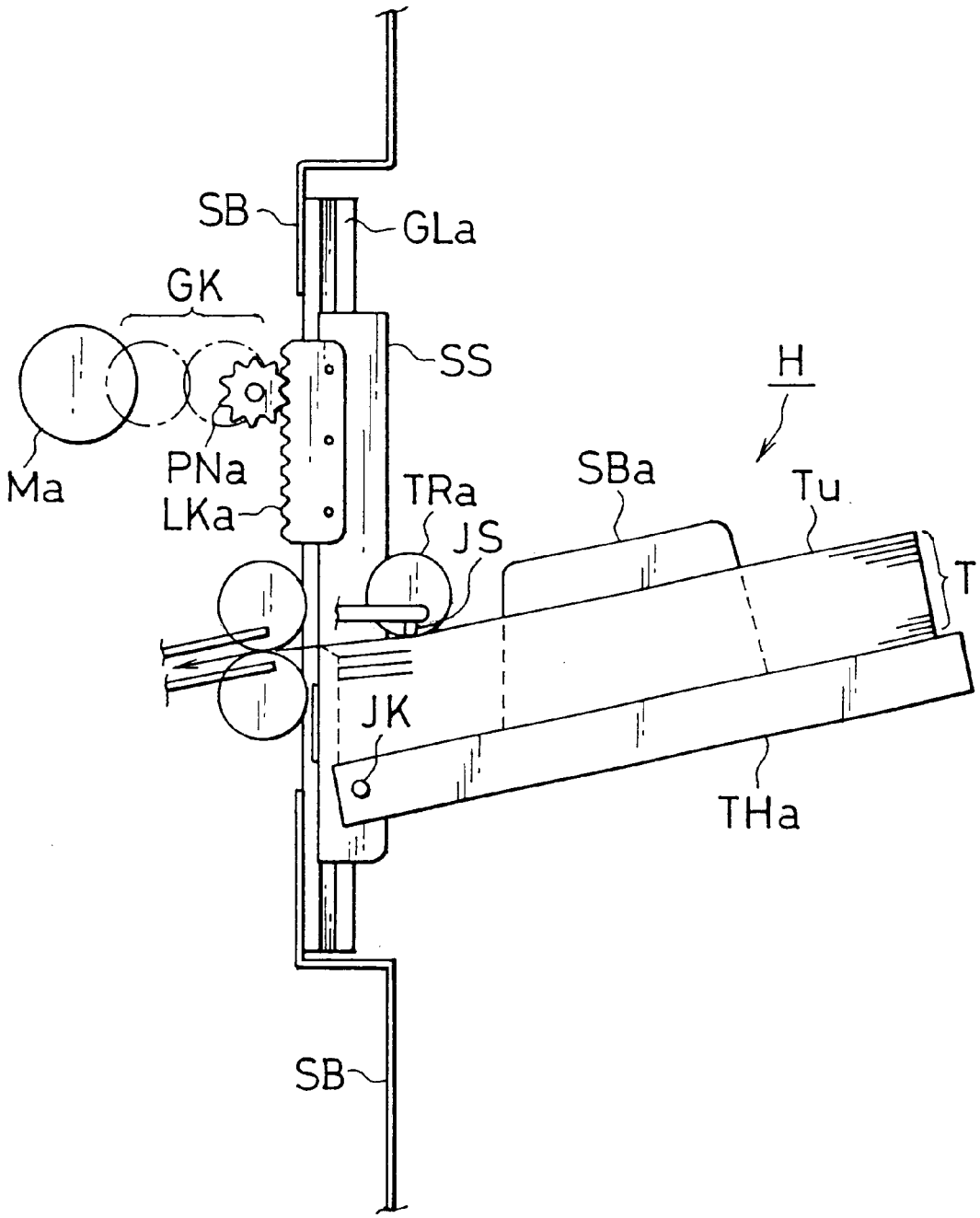
FIG. 6 is a sectional view showing another example of the manual feed apparatus.

As shown in FIG. 6, when a feedout roller TRa is provided in front of (downstream of) the opening/closing tray THa to be close to it and the vertically movable tray THb is omitted, the same effect as that described above can be obtained. In this case, a mechanism for retreating the feedout roller TRa must be separately provided so that when the opening/closing tray THa is to be stored, the feedout roller TRa will not collide against it.

What is claimed is:

1. A manual feed apparatus having an opening/closing tray which can be stored in an image forming apparatus main body by swing operation, and a feedout member which feeds a sheet stacked on the opening/closing tray, wherein the opening/closing tray is swingably connected to a vertically movable support member which is restricted to be movable in a vertical direction, and the apparatus comprises vertically movable means for moving the vertically movable support member in the vertical direction.

2. An apparatus according to claim 1, wherein the sheet is abutted against the feedout member by vertical movement of said vertically movable means.

3. An apparatus according to claim 2, wherein said vertically movable means comprises a rack gear provided to the opening/closing tray or the vertically movable support member, and a pinion gear engageable with the rack gear.

4. An apparatus according to claim 3, wherein both the rack gear and the pinion gear form helical gears, the apparatus has a reference surface on a stationary portion which is not moved by the vertical movement, and an abutting portion on the vertically movable support member, and the abutting portion is abutted against the reference surface by a force in a thrust direction which is generated by driving operation of the pinion gear, thereby positioning the opening/closing tray in a direction perpendicular to a feed direction.

5. An apparatus according to claim 1, wherein said vertically movable means comprises a string material attached to said vertically movable support member, and a take-up member, attached to a stationary portion which is not moved by the vertical movement, to take up the string member.

* * * * *